US007300007B2

(12) United States Patent
Hagedorn et al.

(10) Patent No.: US 7,300,007 B2
(45) Date of Patent: Nov. 27, 2007

(54) CIRCULATING GRINDING PLANT COMPRISING A MILL AND A SIFTER

(75) Inventors: Alexander Hagedorn, Pulheim (DE); Frank Fischer-Helwig, St. Augustin (DE); Christian Splinter, Pulheim (DE); Meinhard Frangenberg, Kürten-Engeldorf (DE)

(73) Assignee: KHD Humboldt Wedag GmbH, Cologne (DE)

( * ) Notice: Subject to any disclaimer, the term of this patent is extended or adjusted under 35 U.S.C. 154(b) by 168 days.

(21) Appl. No.: 10/514,622

(22) PCT Filed: May 14, 2003

(86) PCT No.: PCT/EP03/05017

§ 371 (c)(1),
(2), (4) Date: Jul. 13, 2005

(87) PCT Pub. No.: WO03/097241

PCT Pub. Date: Nov. 27, 2003

(65) Prior Publication Data

US 2005/0284971 A1 Dec. 29, 2005

(30) Foreign Application Priority Data

May 16, 2002 (DE) ..... 102 21 739

(51) Int. Cl.
*B02C 23/22* (2006.01)

(52) U.S. Cl. ..... 241/79.1; 209/143; 241/80; 241/235

(58) Field of Classification Search ..... 241/74, 241/79, 79.1, 80, 97, 235; 209/133, 143
See application file for complete search history.

(56) References Cited

U.S. PATENT DOCUMENTS

| | | | | |
|---|---|---|---|---|
| 4,853,112 | A * | 8/1989 | Brown | 209/142 |
| 5,005,770 | A | 4/1991 | Suessegger | |
| 6,415,998 | B1 * | 7/2002 | Splinter | 241/74 |
| 6,557,790 | B2 * | 5/2003 | Splinter | 241/74 |

FOREIGN PATENT DOCUMENTS

WO WO 99/37404 7/1999

* cited by examiner

*Primary Examiner*—Mark Rosenbaum
(74) *Attorney, Agent, or Firm*—Greer, Burns & Crain, Ltd

(57) ABSTRACT

The aim of the invention is to create a compact circulating grinding plant comprising a product bed comminution roller mill or roller press and a sifter device, in which the problem of mechanically transporting the grinding product that is directed through the circuit is minimized. Said aim is achieved by a circulating grinding plant in which a static cascade sifter is disposed below the gap of the roller press while a subsequent sifter, particularly a dynamic rod basket sifter, is disposed above said roller press. The sifting product discharge area of the static cascade sifter is connected to the sifting air and sifting product inlet of the subsequent sifter via an ascending duct which pneumatically conveys the product.

16 Claims, 1 Drawing Sheet

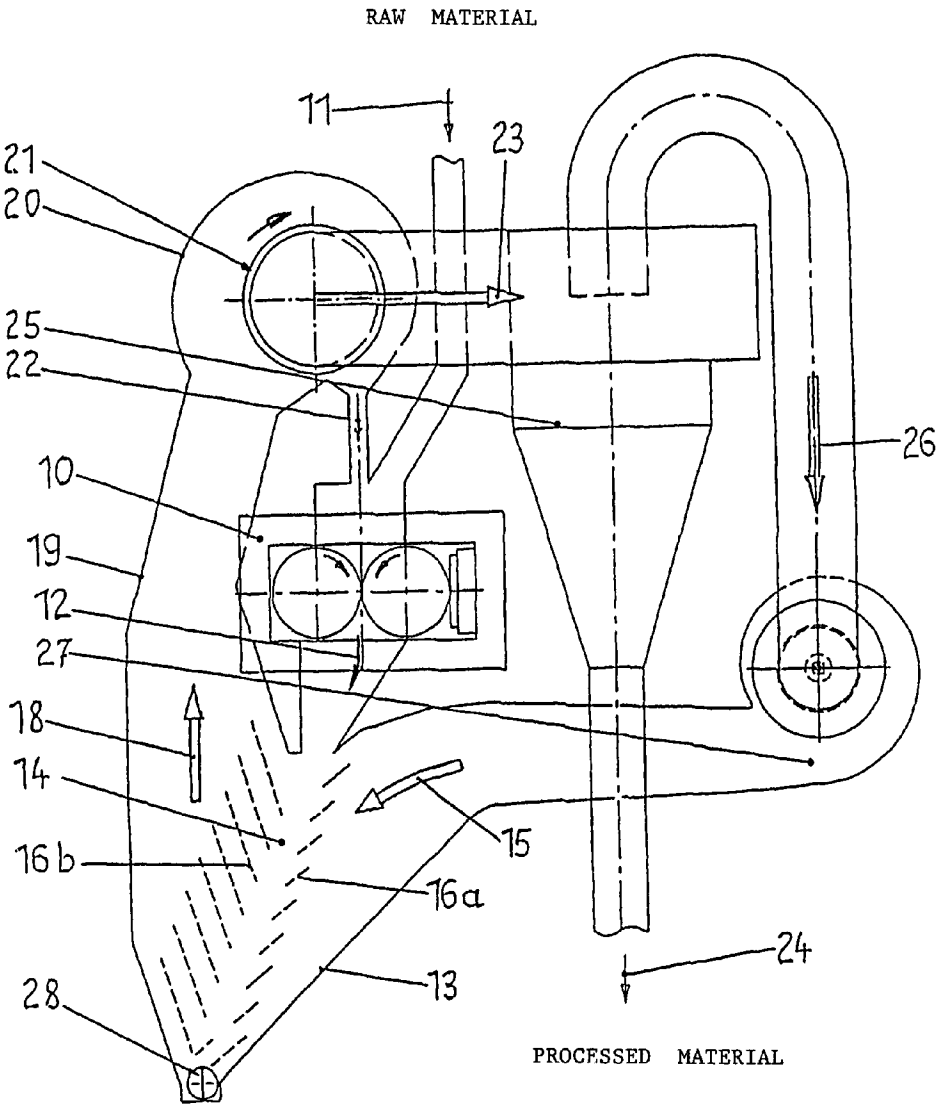
RAW MATERIAL
PROCESSED MATERIAL
11
23
26
24
15
16a
13
21
20
25
22
10
19
12
27
18
14
16b
28

CIRCULATING GRINDING PLANT COMPRISING A MILL AND A SIFTER

BACKGROUND OF THE INVENTION

The invention relates to a circulating grinding plant for the grinding of raw material, with a high-pressure roller mill or roller press with product bed comminution of the feed material and with a sifter device, comprising a static cascade sifter, to which at least one additional sifter is subsequently added on the sifting air current side, whose oversize material discharge is connected to the material feed of the roller press.

Pressure comminution of granular grinding product in the gap between two press rollers is known in the manner that the individual particles of the grinding product are mutually crushed upon application of a high pressure in a material bed compressed between the two roller surfaces, so that in this case one speaks of the so-called product bed comminution. The compression stress results partly in a particle destruction of the grinding product, and partly in the generation of cracks in the particle interior and manifests itself visibly in the formation of agglomerates (so-called scabbing), which can be deagglomerated or dissolved with comparably low expenditure of energy, so that this type of comminution is characterized overall by a comparably low specific power consumption.

In practice such a product bed roller mill or roller press is interconnected with a sifter device to a circulating grinding plant. For example a circulating grinding plant is known both from DE-A-42 23 762 FIG. 2 as well as from EP-B-0 650 763 with a roller press, static cascade sifter and with a subsequent sifter. In the process the static cascade sifter employed as a preliminary sifter and the subsequent sifter subsequently added on the sifting air current side, which can be a dynamic or a static sifter, are each combined into a compact constructional unit. The raw material is fed into the grinding circuit, in particular by means of feeding to the roller press or by means of feeding to the preliminary sifter, and the finished fine processed material is discharged out of the grinding circuit, to be precise by means of the sifter gas stream exiting the subsequent sifter. The cascade sifter acts as a preliminary sifting chamber for the grinding product directed into the circuit as well as acting simultaneously as a deagglomerator for dissolution of the pressure scabs still present in the recycle material so that a dynamic rod basket sifter subsequently added as a subsequent sifter with its rotating turbo elements is no longer loaded with coarse grain components. Both the coarse grain fraction from the static cascade sifter as well as the coarse grain fraction separated from the grinding product by the subsequent sifter can be re-circulated to the roller press for the purpose of repeated product bed stress and further grinding. Depending on the recirculation quantities, the rate of circulation in such a grinding circuit can be high. High grinding circuit rates, i.e., great quantities of circulating scabbing material or great quantities of a mixture of scabbing and raw material cause a considerable expenditure for the mechanical transport of this material to the sifter device, whereby the transport device as a rule consists of a bucket conveyor, which causes not inconsiderable investment and operating expenses.

SUMMARY OF THE INVENTION

The invention solves this task with a circulating grinding plant for a grinding of raw material, having a high-pressure roller mill or roller press, with a pair of opposed rollers separated by a gel, providing product bed comminution of the raw material and having a sifter device, comprising a static cascade sifter provided with a sifting air flow flowing from an inlet side to a sifting air current side, at least one additional sifter positioned on the sifting air current side, the additional sifter having an oversize material discharge connected to a material feed of the roller press.

In the case of the invention's circulating grinding plant with roller press and sifter device, at least one static cascade sifter is disposed beneath the gap of the roller press, said cascade sifter which simultaneously deagglomerates and sifts the scab material coming from the roller press. A static or in particular a dynamic subsequent sifter is arranged above the roller press, in the case of the latter named sifter type at least one rotatably arranged rod basket of a dynamic rod basket sifter provided with turbo elements on the rotor periphery for subsequent sifting of the grinding product directed through the circuit. The gritty material separated by the subsequent sifter, e.g., rod basket sifter is re-circulated by means of a penstock as a result of gravitational effect for material feed of the roller press. The sifting product discharge area of the static cascade sifter is not transported by means of a mechanical conveying agent such as e.g. a bucket conveyor, but rather is pneumatically conveyed through an ascending duct to the sifting air and sifting product inlet of the subsequent sifter, in particular dynamic rod basket sifter. As an ideal, 100% of the product of the circulating grinding plant is pneumatically conveyed through the ascending duct from the static cascade sifter up to the subsequent sifter. This solution saves investment expenses, operating expenses and space for the installation of an otherwise necessary mechanical conveying agent such as a bucket conveyor.

For the case that a grinding product is treated in the invention's circulating grinding plant in which the coarse grain fraction collected in the lower region of the static cascade sifter is not fine enough to be pneumatically conveyed from the sifting air current through the ascending duct to the dynamic rod basket sifter, in accordance with an additional feature of the invention a pulverizer in particular impact pulverizer that pulverizes the sifting coarse grain fraction or the remaining product agglomerates can be integrated in the lower region of the static cascade sifter, e.g. an impact hammer mill, whose rotor spins the sifter coarse grain fraction back up to the static cascade sifter after further pulverizing for the purpose of additional pneumatic conveyance of the grinding product through the ascending duct to the subsequent sifter. However, instead of this, there is also the possibility of equipping the static cascade sifter with a coarse grain fraction discharge opening on its underside, said discharge opening being connected to the material feed of the roller press via an external conveying agent.

BRIEF DESCRIPTION OF THE DRAWING

The invention and its further features and advantages are described in greater detail with the aid of the embodiments schematically represented in the drawing.

DETAILED DESCRIPTION OF THE PREFERRED EMBODIMENT

The drawing shows a compact circulating grinding plant with a product bed comminution roller mill or roller press 10 comprising a pair of opposed rollers forming a gap therebetween and with a sifter device 13. Raw material 11 that is to be ground is fed into the feed well of the roller press 10. The grinding product exits the gap pulverized and partially agglomerated, i.e., pressed into scabs 12, whose percentage of particles already reduced to the desired cement fineness can be relatively high, e.g., 30% smaller than 90 μm.

A static cascade sifter 13 is arranged below the gap of the roller press 10, with the scab material 12 being directed into the cascade sifter's product feed opening from above. The cascade sifter 13 exhibits a v-shaped shaft-shaped case with two sifting zone boundary partitions enclosed by the sifter case and forming a sifting zone 14 between them and which have sifting air 15 (or hot gas as a drying gas in the case of damp feed material) flowing through them, said boundary partitions having cascade-like or louver-like baffle plates 16*a*, 16*b* arranged inclining downward, whereby these two baffle plates and the sifting zone 14 lying between them are arranged lying at an angle deviating from a vertical line.

When gravity causes the scab material 12 to fall from above to below through the baffle plate it cascades upon the impact of the product particularly to baffle plates 16*a* and 16*b*, and with the circulation of the product, the product agglomerates are deagglomerated and the sifting product is simultaneously sifted in the cross-flow.

The cascade sifter 13 is closed at its underside. The sifting product discharge of the cascade sifter 13 is pneumatically conveyed, suspended in the sifter exhaust 18 via an ascending duct 19 past the roller press 10 to the sifting air and sifting product inlet of a subsequent sifter, in the drawing shown as a dynamic rod basket sifter 20, whose pivoted rod basket 21 equipped with turbo elements is arranged at the rotor periphery with e.g., a horizontal rotational axis above the roller press 10. While the coarse grain fraction (grit) is discharged at the periphery of the rotating rod basket 21 with a fineness, e.g., 100% less than about 500 μm, said grain fraction is re-circulated via a penstock 22 to the product feed well of the roller press 10, the flow of sifting air/finished product represented by the arrow 23 is discharged via at least one of the two frontal areas of the rotating rod basket 21 and directed through a cyclone centrifugal separator 25 for the purpose of separation of the fine finished product 24 at a finished product fineness, e.g. 100% less than about 32 μm, whose exhaust air 26 is re-circulated via a ventilator 27 as sifting air 15 in the static cascade sifter 13.

There is also the possibility of taking the raw material 11, e.g., if it exhibits a high humidity, and instead of feeding it at the product feed well of the roller press 10, feeding it at its product discharge and hence feeding it into the circulating grinding plant at the material feed of the static cascade sifter 13 and then using a hot drying gas as the sifting air stream 15.

For the case that the coarse grain fraction gathering in the lower region of the static cascade sifter 13 is not fine enough to be transported by the sifting air flow 18 through the ascending duct 19 up to the dynamic rod basket sifter 20, a pulverizer, in particular impact pulverizers 28, such as e.g., an impact hammer mill that further pulverizes the sifter-coarse grain fraction or any product agglomerates, can be integrated in the lower region of the cascade sifter 13, said hammer mill having a rotor which keeps spinning the sifter coarse grain fraction back into the sifter until it is fine enough to be pneumatically conveyed above through the ascending duct 19.

The circulating grinding plant of the invention also allows for the possibility of using a tube mill or ball mill or the like in place of the high pressure roller mill or roller press.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A circulating grinding plant for a grinding of raw material, comprising a high-pressure roller mill or roller press providing product bed comminution of the raw material and having a sifter device, further comprising a static cascade sifter provided with sifting air flow flowing from an inlet side to sifting air current side, at least one additional sifter positioned on the sifting air current side, said additional sifter having an oversize material discharge connected to a material feed of the roller press, the static cascade sifter being disposed beneath a gap of the roller press, the subsequent sifter having a coarse grain discharge pipe being disposed above the roller press, a sifting material discharge area of the static cascade sifter being connected to one of a sifting air and a sifting product inlet of the subsequent sifter via an ascending duct provided with an airflow arranged to pneumatically convey the product.

2. A circulating grinding plant according to claim 1, wherein the static cascade sifter has a v-shaped shaft-shaped case with two sifting zone boundary partitions enclosed by the sifter case and forming a sifting zone between them which have sifting air or hot gas as a drying gas flowing through them, said boundary partitions having louvered baffle plates arranged inclining downward, whereby these two baffle plates and the sifting zone lying between them are arranged lying at an angle deviating from vertical.

3. A circulating grinding plant according to claim 1, wherein the subsequent sifter is a dynamic rod basket sifter with at least one pivoted rod basket equipped with turbo elements arranged at a rotor periphery.

4. A circulating grinding plant according to claim 1, wherein the static cascade sifter includes a coarse grain fraction discharge opening at its underside, said discharge opening being connected to a material feed of the roller press via a conveying agent.

5. A circulating grinding plant for a grinding of raw material, comprising a high-pressure roller mill or roller press providing product bed comminution of the raw material and having a sifter device, further comprising a static cascade sifter provided with sifting air flow flowing from an inlet side to sifting air current side, at least one additional sifter positioned on the sifting air current side, said additional sifter having an oversize material discharge connected to a material feed of the roller press, the static cascade sifter being disposed beneath a gap of the roller press, the subsequent sifter having a coarse grain discharge pipe being disposed above the roller press, a sifting material discharge area of the static cascade sifter being connected to one of a sifting air and a sifting product inlet of the subsequent sifter via an ascending duct provided with an airflow arranged to pneumatically convey the product, wherein in a lower region of the static cascade sifter an impact pulverizer is integrated which further pulverizes a sifter coarse grain fraction or product agglomerates.

6. A circulating grinding plant according to claim 5, wherein the integrated pulverizer is an impact hammer mill, whose rotor is arranged to spin a sifter coarse grain fraction back into the static cascade sifter for the purpose of further pneumatic conveyance of the grinding product through the ascending duct to the subsequent sifter.

7. A circulating grinding plant for a grinding of raw material, comprising a comminution mill, a static cascade sifter disposed beneath the comminution mill to gravitationally receive a product comprising raw material that has been ground by the mill, the cascade sifter being provided with sifting air flow flowing from an inlet side to sifting air current side, a sifting material discharge area of the static cascade sifter being connected to an ascending duct provided with an airflow arranged to pneumatically convey the product to an elevation above the comminution mill, at least one additional sifter with a sifting air and a sifting product inlet connected to an upper end of the ascending duct, said additional sifter having an oversize material discharge disposed above and connected to the comminution mill.

8. A circulating grinding plant according to claim 7, wherein the comminution mill comprises a high-pressure pressure roller mill.

9. A circulating grinding plant according to claim 7, wherein the comminution mill comprises a roller press.

10. A circulating grinding plant according to claim 7, wherein the comminution mill comprises a tube mill.

11. A circulating grinding plant according to claim 7, wherein the comminution mill comprises a ball mill.

12. A circulating grinding plant according to claim 7, wherein the static cascade sifter has a v-shaped shaft-shaped case with two sifting zone boundary partitions enclosed by the sifter case and forming a sifting zone between them which have sifting air or hot gas as a drying gas flowing through them, said boundary partitions having louvered baffle plates arranged inclining downward, whereby these two baffle plates and the sifting zone lying between them are arranged lying at an angle deviating from vertical.

13. A circulating grinding plant according to claim 7, wherein the additional sifter is a dynamic rod basket sifter with at least one pivoted rod basket equipped with turbo elements arranged at a rotor periphery.

14. A circulating grinding plant according to claim 7, wherein in a lower region of the static cascade sifter an impact pulverizer is integrated which further pulverizes a sifter coarse grain fraction or product agglomerates.

15. A circulating grinding plant according to claim 14, wherein the integrated pulverizer is an impact hammer mill, whose rotor is arranged to spin a sifter coarse grain fraction back into the static cascade sifter for the purpose of further pneumatic conveyance of the grinding product through the ascending duct to the additional sifter.

16. A circulating grinding plant according to claim 7, wherein the static cascade sifter includes a coarse grain fraction discharge opening at its underside, said discharge opening being connected to a material feed of the roller press via a conveying agent.

* * * * *